US012729697B2

(12) United States Patent
Chang et al.

(10) Patent No.: US 12,729,697 B2
(45) Date of Patent: Sep. 8, 2026

(54) AIR GUIDE RING AND AXIAL FLOW FAN COMPRISING SAME

(71) Applicants: York Guangzhou Air Conditioning and Refrigeration Co., Ltd., Qingyuan City (CN); Tyco Fire & Security GmbH, Neuhausen am Rheinfall (CH)

(72) Inventors: Baojun Chang, Qingyuan City (CN); Qinghua Tang, Qingyuan City (CN); Xiaokui Ma, Qingyuan City (CN); Li Wang, Qingyuan City (CN)

(73) Assignees: York Guangzhou Air Conditioning and Refrigeration Co., Ltd., Qingyuan (CN); Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/878,775

(22) PCT Filed: Jun. 27, 2023

(86) PCT No.: PCT/US2023/026364
§ 371 (c)(1),
(2) Date: Dec. 24, 2024

(87) PCT Pub. No.: WO2024/006293
PCT Pub. Date: Jan. 4, 2024

(65) Prior Publication Data

US 2025/0382973 A1 Dec. 18, 2025

(30) Foreign Application Priority Data

Jun. 27, 2022 (CN) ..... 202210743225.0

(51) Int. Cl.
*F04D 29/54* (2006.01)
*F04D 19/00* (2006.01)
(Continued)

(52) U.S. Cl.
CPC ..... *F04D 29/545* (2013.01); *F04D 19/002* (2013.01); *F04D 29/665* (2013.01)

(58) Field of Classification Search
CPC .. G10K 11/172; G10K 11/168; G10K 11/162; G10K 2210/1281; G10K 11/16;
(Continued)

(56) References Cited

U.S. PATENT DOCUMENTS 5,962,823 A * 10/1999 Asahara ..... B60R 13/0861 181/292
6,352,134 B1 * 3/2002 Wang ..... E04B 9/34 181/292
(Continued)

FOREIGN PATENT DOCUMENTS

CN 107956746 A 4/2018
CN 109210013 A 1/2019
(Continued)

OTHER PUBLICATIONS

Machine Translation of CN111853966A [retrieved on 2025-09-23]. Retrieved from: Espacenet. (Year: 2025).*
PCT International Search Report and Written Opinion for PCT Application No. PCT/US2023/026364, mailed Oct. 18, 2023, 10 pgs.

*Primary Examiner* — Eric J Zamora Alvarez
(74) *Attorney, Agent, or Firm* — Fletcher Yoder, P.C.

(57) ABSTRACT

An air guide ring includes an annular air guide portion having an air duct that accommodates an impeller of an axial flow fan configured to rotate therein. The annular air guide portion has an inner side wall and an outer side wall, the air duct is enclosed by the inner side wall, and a plurality of noise reduction devices is arranged on the inner side wall of the annular air guide portion in a circumferential direction of the air guide ring The plurality of noise reduction devices is configured to reduce noise in the air duct.

19 Claims, 5 Drawing Sheets

A-A

(51) Int. Cl.
*F04D 29/52* (2006.01)
*F04D 29/66* (2006.01)

(58) Field of Classification Search
CPC ..... G10K 11/175; B32B 3/12; B32B 3/266; B32B 2307/102; B32B 2607/00; B32B 2307/10; B32B 2305/024; B32B 2307/56; F02C 7/045; F02C 7/24; F02K 1/827; F05D 2260/96; F05D 2260/963; F05D 2220/323; F05D 2250/283; F05D 2300/514; Y10T 428/24149; Y10T 428/24273; Y10T 428/236; F04D 19/002; F04D 29/663; F04D 17/16; F04D 17/167; F04D 29/023; F04D 29/5853; F04D 29/545; F04D 29/665; F04D 29/4226; F04D 29/703; E04B 1/74; E04B 1/82; E04B 1/8209; E04B 2001/8433; E04B 2001/8428; E04B 2001/748
See application file for complete search history.

(56) References Cited

U.S. PATENT DOCUMENTS

| | | | | |
|---|---|---|---|---|
| 7,337,875 | B2 * | 3/2008 | Proscia | F02C 7/24 181/290 |
| 8,068,339 | B2 * | 11/2011 | Kayama | F04D 29/384 361/679.48 |
| 2020/0309028 | A1 | 10/2020 | Murugappan et al. | |
| 2022/0194607 | A1 | 6/2022 | Ward | |

FOREIGN PATENT DOCUMENTS

| | | | | |
|---|---|---|---|---|
| CN | 109707668 | A | 5/2019 | |
| CN | 210951546 | U | 7/2020 | |
| CN | 111853966 | A | * 10/2020 | G10K 11/16 |
| CN | 214304538 | U | 9/2021 | |
| CN | 216478059 | U | 5/2022 | |
| CN | 115111201 | A | 9/2022 | |
| DE | 102015224344 | A1 | 6/2017 | |
| JP | H1193670 | A | 4/1999 | |
| JP | 2911236 | B2 | 6/1999 | |

* cited by examiner

A-A

B-B

AIR GUIDE RING AND AXIAL FLOW FAN COMPRISING SAME

CROSS-REFERENCE TO RELATED APPLICATIONS

This application is a U.S. National Stage Application of International Application No. PCT/US2023/026364, entitled "AIR GUIDE RING AND AXIAL FLOW FAN COMPRISING SAME," filed Jun. 27, 2023, which claims priority to and the benefit of Chinese Patent Application No. 202210743225.0, filed Jun. 27, 2022, each of which is hereby incorporated by reference in its entirety for all purposes.

TECHNICAL FIELD

The present application relates to the field of axial flow fans, in particular to an air guide ring and an axial flow fan comprising the same.

BACKGROUND ART

An axial flow fan comprises an impeller and an air guide ring, the impeller rotates in the air guide ring to drive the air to flow from one side of the axial flow fan to the other side in the axial direction of the axial flow fan, such that a pressure difference is formed on upper and lower sides of blades of the impeller in the axial direction, which is specifically represented by forming pressure surfaces in high-pressure areas of the blades and forming suction surfaces in low-pressure areas of the blades. Generally speaking, a certain gap needs to be provided between the air guide ring and the impeller in the radial direction of the axial flow fan so as to prevent the impeller from colliding with the air guide ring. Due to the presence of the gap, the air at tips of the blades flows from the pressure surfaces of the blades to the suction surfaces under the influence of the pressure difference, producing air flow disturbances at the gap, and thereby causing noise.

SUMMARY OF THE INVENTION

At least one purpose of the present application in a first aspect is to provide an air guide ring for an axial flow fan, comprising: an annular air guide portion, wherein the annular air guide portion has an axis and is rotationally symmetric about the axis, and the annular air guide portion comprises an air duct for accommodating an impeller of the axial flow fan to rotate therein, wherein the annular air guide portion comprises an inner side wall and an outer side wall, and the air duct is enclosed by the inner side wall; and a plurality of noise reduction devices, wherein the plurality of noise reduction devices are arranged on the inner side wall of the annular air guide portion in a circumferential direction of the air guide ring, and wherein each of the noise reduction devices is configured to reduce noise in the air duct.

According to the content of the first aspect described above, each of the noise reduction devices is configured to have a preset inherent frequency so as to reduce the noise in the air duct by resonating with sound waves having the preset inherent frequency in the noise.

According to the content of the first aspect described above, at least part of the plurality of noise reduction devices are configured to have different preset inherent frequencies.

According to the content of the first aspect described above, each of the noise reduction devices comprises a resonant cavity and a connecting tube, the resonant cavity is provided between the inner side wall and the outer side wall, and the connecting tube is connected to the inner side wall and extends towards the corresponding resonant cavity, wherein a channel is provided inside the connecting tube, and the channel is in fluid communication with the corresponding resonant cavity and the air duct.

According to the content of the first aspect described above, the resonant cavity and the channel of each of the noise reduction devices extend in a radial direction perpendicular to the inner side wall and the outer side wall.

According to the content of the first aspect described above, the plurality of noise reduction devices are evenly arranged in an array in the circumferential direction.

According to the content of the first aspect described above, the plurality of noise reduction devices comprise a plurality of annular dividing walls, and each of the annular dividing walls is connected between the inner side wall and the outer side wall; and the plurality of noise reduction devices further comprise: first noise reduction devices, wherein the first noise reduction devices comprise first resonant cavities, and the first resonant cavities are enclosed by the annular dividing walls; and second noise reduction devices, wherein the second noise reduction devices comprise second resonant cavities, and the second resonant cavities are formed between adjacent annular dividing walls.

According to the content of the first aspect described above, each of the noise reduction devices is configured to form the preset inherent frequency by means of the volume of the resonant cavity, the length of the connecting tube and the inner tube diameter of the connecting tube.

According to the content of the first aspect described above, the preset inherent frequency of each of the noise reduction devices is different from those of adjacent noise reduction devices.

At least one purpose of the present application in a second aspect is to provide an axial flow fan, comprising: an impeller; and the air guide ring according to any one of the first aspect.

Other features, advantages and embodiments of the present application can be elaborated or become obvious by considering the following detailed description of embodiments, drawings and claims. In addition, it should be understood that the summary of the invention above and the detailed description of embodiments below are exemplary and are intended to provide further explanations without limiting the scope of the claimed present application. However, the detailed description of embodiments and the particular examples only indicate the preferred embodiments of the present application. For a person skilled in the art, various changes and modifications within the spirit and scope of the present application would have been obvious by means of the detailed description of embodiments.

DETAILED DESCRIPTION OF EMBODIMENTS

Figure 1A:
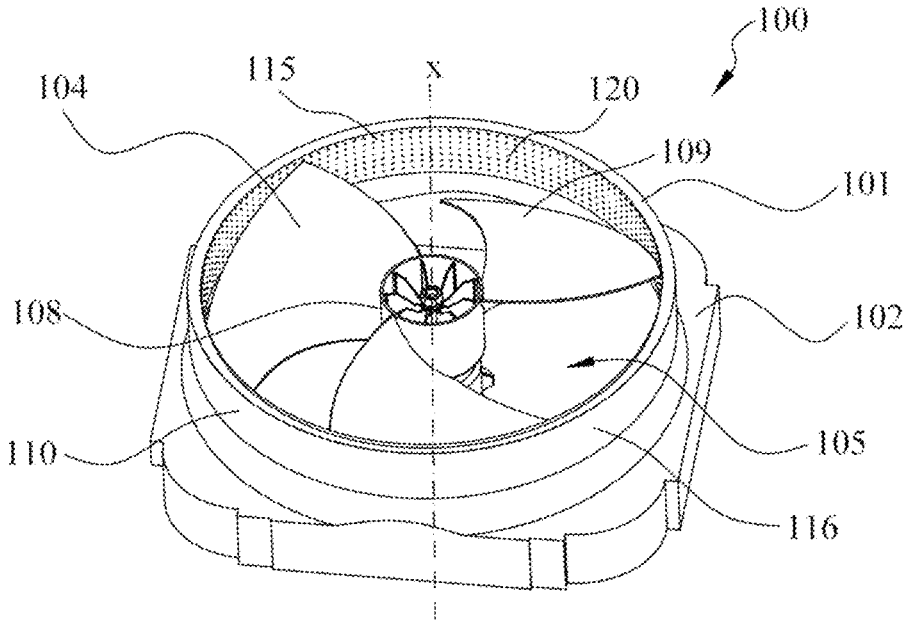
FIG. 1A is a three-dimensional structure diagram of an axial flow fan according to an embodiment of the present application.

Various particular embodiments of the present application will be described below with reference to the drawings constituting part of the specification. It should be understood that although terms, such as "front", "rear", "upper", "lower", "left", "right", "top", "bottom" and the like, indicating directions are used in the present application to describe various exemplary structural portions and elements of the present application, these terms are only used herein for convenience of illustration and are determined on the basis of the example orientations as shown in the drawings. The embodiments disclosed in the present application can be arranged in different directions, so that these terms indicating the directions are only for illustration and should not be considered as limitations.

Figure 1B:
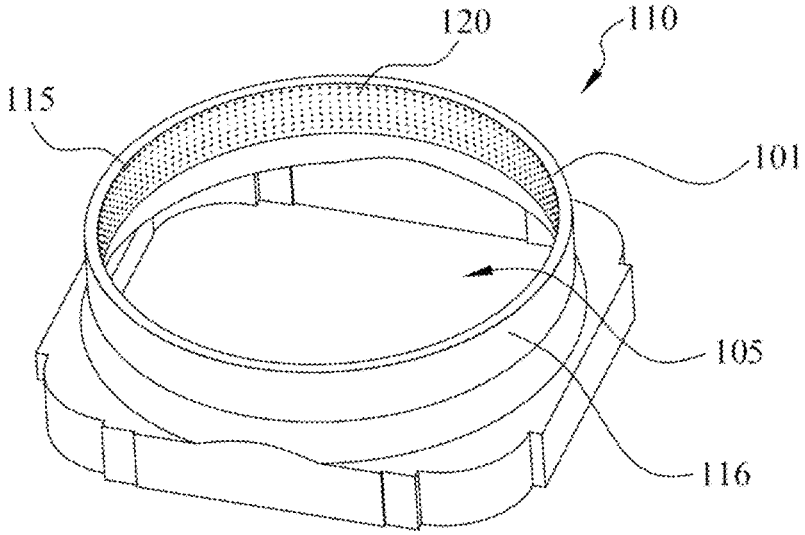
FIG. 1B is a three-dimensional structure diagram of an air guide ring of the axial flow fan in FIG. 1A.

FIG. 1A is a three-dimensional structure diagram of an axial flow fan 100, and FIG. 1B is a three-dimensional structure diagram of an air guide ring 110 in FIG. 1A. As shown in FIG. 1A and FIG. 1B, the axial flow fan 100 comprises the air guide ring 110 and an impeller 104, wherein the air guide ring 110 is internally provided with an air duct 105, and the impeller 104 is arranged in the air duct 105 and rotates along an axis x. The impeller 104 comprises a plurality of blades 109 arranged around a hub 108 thereof, and the hub 108 is connected to an electric motor (not shown in the drawings) for driving the blades 109 to rotate. During the rotation process of the impeller 104, an air fluid flows from the position below the axial flow fan 100 to the position above the axial flow fan 100 so as to drive the air to flow from bottom to top, thereby forming a pressure difference between upper surfaces and lower surfaces of the blades 109. The upper surfaces have a relatively high pressure and are pressure surfaces, and the lower surfaces have a relatively low pressure and are suction surfaces. When the pressure difference exists between the upper surfaces and the lower surfaces of the blades 109, the air inevitably flows to the suction surfaces from the pressure surfaces of the blades 109 through a gap, and a sudden change of the direction of the air at the gap will incur air flow disturbances, thereby causing noise. The air guide ring 110 of the present application is provided with a plurality of noise reduction devices 120 so as to reduce or eliminate the noise in the air duct 105.

Specifically, the air guide ring 110 comprises an annular air guide portion 101 and a mounting portion 102, and the annular air guide portion 101 is supported on the mounting portion 102. The annular air guide portion 101 is roughly in a circular ring shape rotationally symmetric about the axis x, and the air duct 105 is formed inside the annular air guide portion. The annular air guide portion 101 has a certain thickness and comprises an inner side wall 115 provided on an inner side of the annular air guide portion 101 and an outer side wall 116 provided on an outer side. The air duct 105 is enclosed by the inner side wall 115. That is, the gap is formed between each of the blades 109 of the impeller 104 and the inner side wall 115 of the annular air guide portion 101, and when the impeller 104 rotates in the air duct 105, the air flows through the gaps to cause the noise. The plurality of noise reduction devices 120 are arranged on the inner side wall 115 so as to directly reduce or eliminate, at portions where the noise is generated, the noise in the air duct 105. In this embodiment, the plurality of noise reduction devices 120 are arranged on the inner side wall 115 in a certain manner, for example, the plurality of noise reduction devices 120 are evenly arranged in the circumferential direction of the annular air guide portion 101. The specific structure of the noise reduction device 120 will be described in detail in conjunction with FIGS. 2A-2B and FIGS. 3A-3D.

The mounting portion 102 is used for connecting and fixing the hub 108 such that the impeller 104 of the axial flow fan 100 can be accommodated in the air duct 105 and rotates in the air duct 105. The mounting portion 102 can also be used for mounting the axial flow fan 100 and other external components (not shown in the drawings) so as to fix the axial flow fan 100.

Figure 2A:
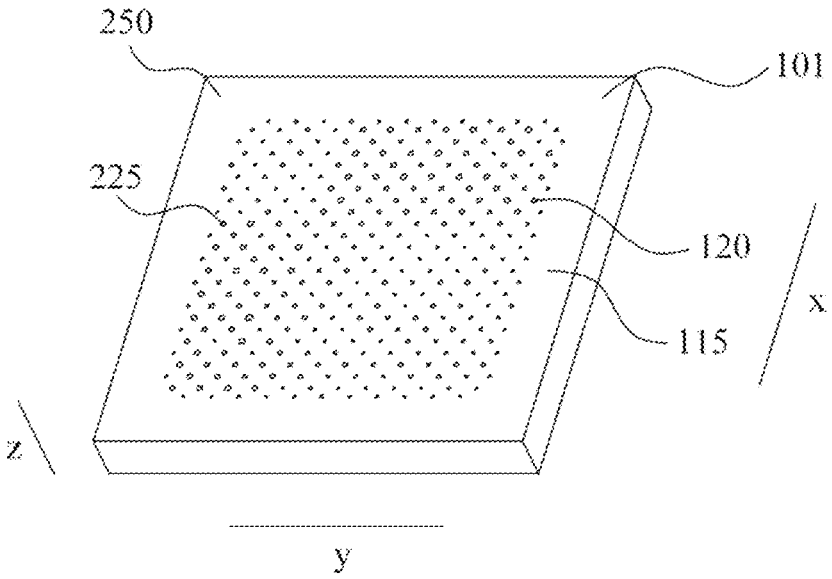
FIG. 2A is a partial expanded view of the air guide ring in FIG. 1B.
Figure 2B:
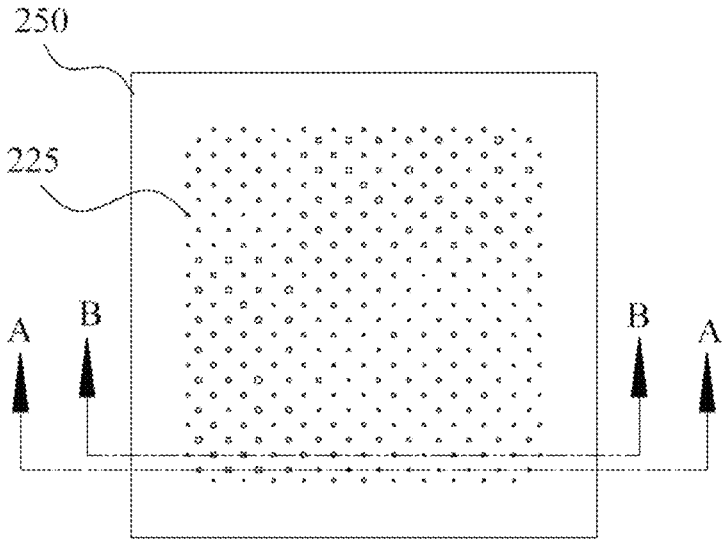
FIG. 2B is a top view of FIG. 2A.

FIGS. 2A-2B show partial expanded structures of the annular air guide portion 101 of the air guide ring 110. The expanded view of the annular air guide portion 101 is a cuboid having a certain thickness, and FIGS. 2A-2B show part of the expanded view. FIG. 2A shows the three-dimensional structure of the partial expanded view of the annular air guide portion 101, and FIG. 2B shows the top view of FIG. 2A. As shown in FIGS. 2A-2B, the annular air guide portion 101 is partially expanded to form an expanded air guide portion 250, the expanded air guide portion 250 is in a cuboid shape having a certain height and has a cross section being roughly in a square shape, one length direction thereof represents the axial direction of the annular air guide portion 101, the other length direction represents the circumferential direction of the annular air guide portion 101, and the height direction z represents the radial direction of the annular air guide portion 101. Therefore, in the partial expanded view of the annular air guide portion 101 in FIG. 2A and FIG. 2B, an upper surface of the expanded air guide portion 250 represents the inner side wall 115, and a lower surface of the expanded air guide portion 250 represents the outer side wall 116. the plurality of noise reduction devices 120 are evenly arranged in an array on the inner side wall 115 (i.e. the upper surface in FIG. 2A and FIG. 2B) of the annular air guide portion 101 in the circumferential direction of the annular air guide portion 101, each of the noise reduction devices 120 forms a hole 225 in the inner side wall 115, and accommodating cavities inside respective noise reduction devices 120 can be in fluid communication with the air duct 105 by means of these holes 225. In this embodiment, the noise reduction devices 120 are resonant noise reduction devices, and each of the noise reduction devices 120 has a preset inherent frequency and eliminates sound waves by resonating with the sound waves having the preset inherent frequency in the noise in the air duct 105, thereby achieving the noise reduction effect. When at least part of the noise reduction devices 120 have different preset inherent frequencies, the sound waves having different frequencies in the noise can be eliminated. In this embodiment, the preset inherent frequencies of the plurality of noise reduction devices 120 are set to be able to eliminate the sound waves having the frequencies of 400-1200 Hz in the noise in the air duct 105.

Figure 3A:
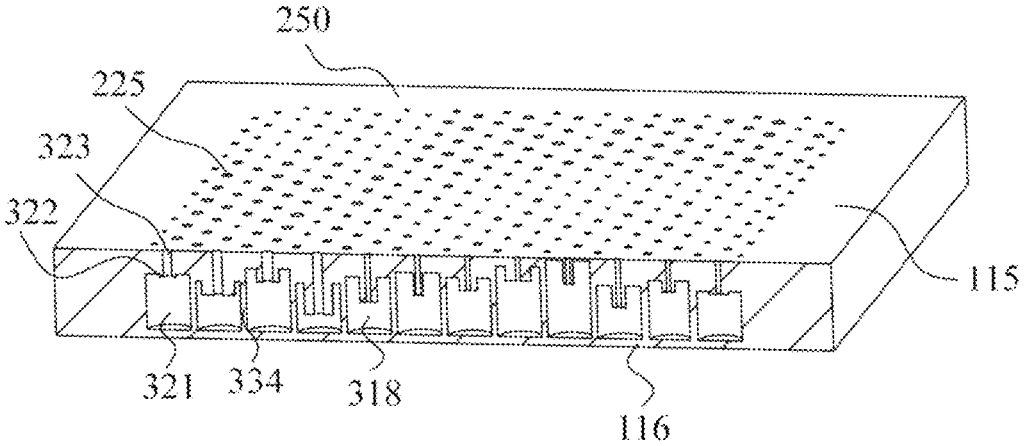
FIG. 3A and FIG. 3B are sectional views of the air guide ring in FIG. 2B along lines A-A and B-B.
Figure 3B:
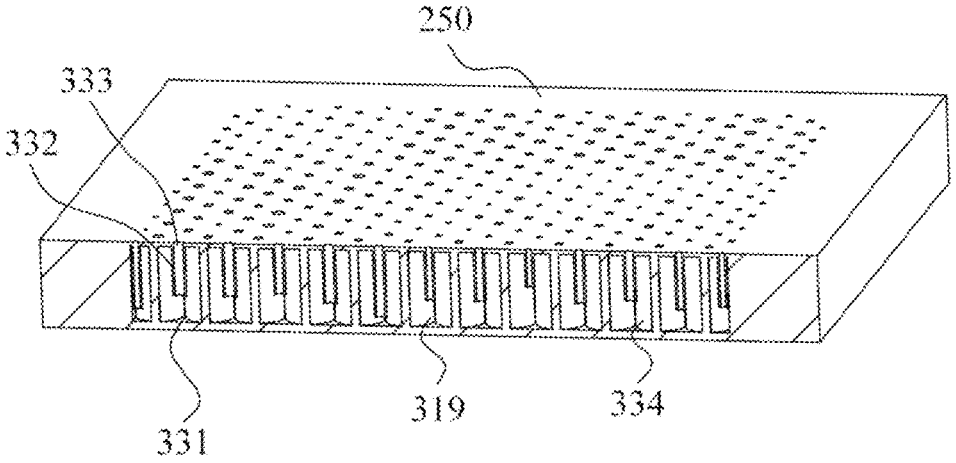
Figure 3C:
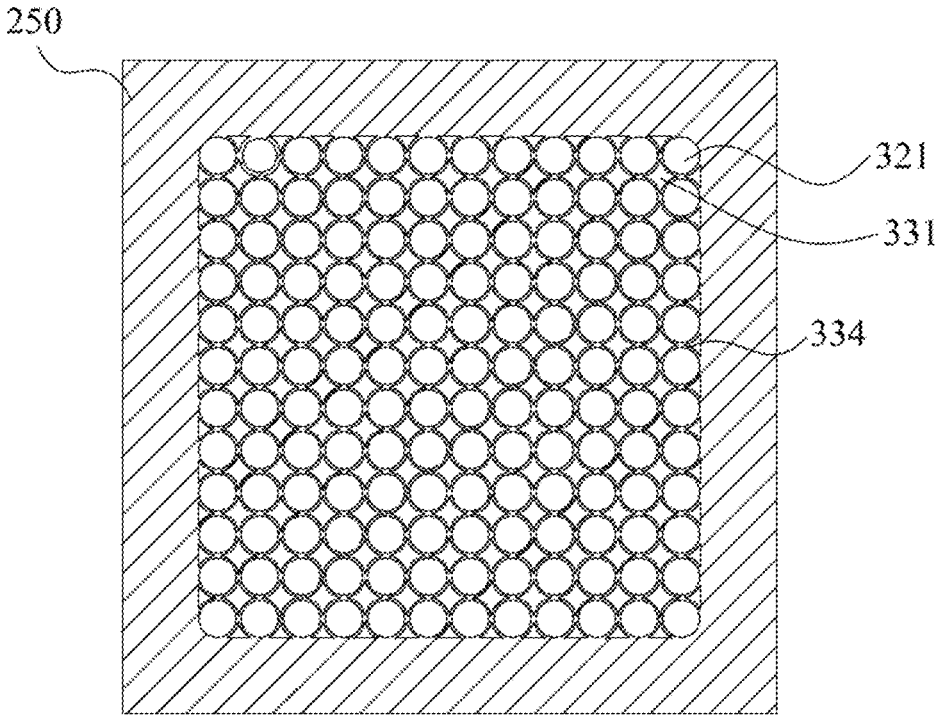
FIG. 3C is a transverse sectional view of FIG. 2A.
Figure 3D:
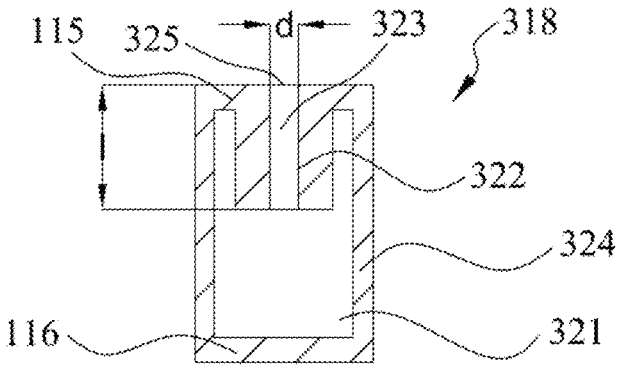
FIG. 3D is a partial structure diagram of a single noise reduction device in FIG. 2A.

FIGS. 3A-3D show the specific structure diagrams of the noise reduction device 120. With further reference to FIGS. 3A-3D, the plurality of noise reduction devices 120 comprise a plurality of first noise reduction devices 318 arranged in rows and columns and a plurality of second noise reduction devices 319 arranged in rows and columns, and each row of the first noise reduction devices 318 are staggered with each row of the second noise reduction devices 319. FIG. 3A shows the sectional view of the expanded air guide portion 250 at the first noise reduction devices 318, FIG. 3B shows the sectional view of the expanded air guide portion 250 at the second noise reduction devices 319, FIG. 3C shows the transverse sectional view of the expanded air guide portion 250, and FIG. 3D shows the specific structure of the single first noise reduction device 318.

Each of the first noise reduction devices 318 comprises a first resonant cavity 321 and a first connecting tube 322, the first resonant cavity 321 is provided between the inner side wall 115 and the outer side wall 116, and the first connecting tube 322 is formed in a manner that extends from the inner side wall 115 to the interior of the corresponding first resonant cavity 321. A channel 323 is formed in the first connecting tube 322. One end of the channel 323 forms the hole 225 in the inner side wall 115, and the other end of the channel 323 extends into the corresponding first resonant cavity 321 and is in fluid communication with the first resonant cavity 321. By means of the channel 323, the first resonant cavity 321 can be in fluid communication with the air duct 105.

Similarly, each of the second noise reduction devices 319 comprises a second resonant cavity 331 and a second connecting tube 332, the second resonant cavity 331 is provided between the inner side wall 115 and the outer side wall 116, and the second connecting tube 332 is formed in a manner that extends from the inner side wall 115 to the interior of the corresponding second resonant cavity 331. A channel 333 is formed in the second connecting tube 332. One end of the channel 333 forms the hole 225 in the inner side wall 115, and the other end of the channel 333 extends into the corresponding second resonant cavity 331 and is in fluid communication with the second resonant cavity 331. By means of the channel 333, the second resonant cavity 331 can also be in fluid communication with the air duct 105.

In this embodiment, the noise reduction devices 120 comprise a plurality of annular dividing walls 334, and each of the annular dividing walls 334 is in a cylindrical shape with the top thereof being connected to the inner side wall 115 and the bottom thereof being connected to the outer side wall 116. The first resonant cavity 321 of the first noise reduction device 318 is in a cylindrical shape enclosed by the annular dividing wall 334 and closed in the circumferential direction thereof, and the second resonant cavity 331 of the second noise reduction device 319 is in an irregularly columnar shape formed among the adjacent annular dividing walls 334. In this embodiment, each of the annular dividing walls 334 forming each of the first resonant cavities 321 is arranged side by side and in parallel, the axis of each of the annular dividing walls 334 is parallel to one another, and adjacent annular dividing walls 334 are connected to one another, so that the second resonant cavity 331 closed in the circumferential direction thereof can be formed among adjacent annular dividing walls 334. The cross section of each of the annular dividing walls 334 is approximately the same in size. That is, the first resonant cavities 321 are arranged in a matrix, and the cross sections of the first resonant cavities 321 are approximately the same in size. One second resonant cavity 331 is provided in every four adjacent first resonant cavities 321. Therefore, the first noise reduction devices 318 and the second noise reduction devices 319 can be compactly distributed in the circumferential direction of the annular air guide portion 101.

In this embodiment, each of the first resonant cavities 321 that is cylindrical shaped is approximately the same in diameter, but is different in height, so that the volume of each first resonant cavity 321 is different. Similarly, each of the second resonant cavities 331 in an irregularly columnar shape is approximately the same in cross section size, but is different in height, so that the volume of each second resonant cavity 331 can also be different. In other embodiments, the cross section size of each of the first resonant cavities 321 may not be identical, and all that is required is to ensure that the adjacent annular dividing walls 334 can be connected to one another to form the second resonant cavities 331 closed in the circumferential direction.

The first connecting tube 322 is in a round tube shape, is arranged at the top of the first resonant cavity 321 and is connected to an inner side of the inner side wall 115. The first connecting tube 322 and the channel 323 thereof extend coaxially in the radial direction of the annular air guide portion 101 (i.e., the height direction of the expanded air guide portion 250). In this embodiment, the channel 323 and the first resonant cavity 321 are formed coaxially, the first connecting tube 322 extends into the first resonant cavity 321 from the middle position of the inner side wall 115 corresponding to the top of the first resonant cavity 321, and the first connecting tube 322 and the channel 323 thereof are approximately perpendicular to the inner side wall 115 and the outer side wall 116.

Similarly, the second connecting tube 332 is also in round tube shape, is arranged at the top of the second resonant cavity 331 and is connected to the inner side of the inner side wall 115. The second connecting tube 332 and the channel 333 thereof also extend coaxially in the radial direction of the annular air guide portion 101 (i.e., the height direction of the expanded air guide portion 250). In this embodiment, the second connecting tube 332 extends into the second resonant cavity 331 from the middle position of the inner side wall 115 corresponding to the top of the second resonant cavity 331, and the second connecting tube 332 and the channel 333 thereof are also approximately perpendicular to the inner side wall 115 and the outer side wall 116. That is, the first connecting tube 322 and the channel 323 thereof are approximately parallel to the second connecting tube 332 and the channel 333 thereof.

In this embodiment, the preset inherent frequency f of each of the noise reduction devices 120 is as follows:

$$f = \frac{c}{2\pi}\sqrt{\frac{S}{(l+0.8d)V}};$$

wherein c represents the sound velocity, S represents the sectional area of the hole corresponding to the respective connecting tube, d represents the inner tube diameter of the respective connecting tube, l represents the length of the respective connecting tube, and V represents the volume of the respective resonant cavity. That is, the noise reduction devices having different preset inherent frequencies can be obtained by setting the volumes of the resonant cavities, the lengths of the connecting tubes and the inner tube diameters of the connecting tubes.

As an example, the preset inherent frequency of each of the noise reduction devices 120 is different from those of adjacent noise reduction devices 120, for example, the preset inherent frequency of each noise reduction device 120 has an interval of 1 Hz; for example, the preset inherent frequencies of the noise reduction devices 120 are respectively 400 Hz, 401 Hz, 402 Hz, etc., and about 800 noise reduction devices 120 are arranged on the annular air guide portion 101 such that the preset inherent frequencies of the plurality of noise reduction devices 120 cover the range of 400 Hz-1200 Hz.

Figure 4:
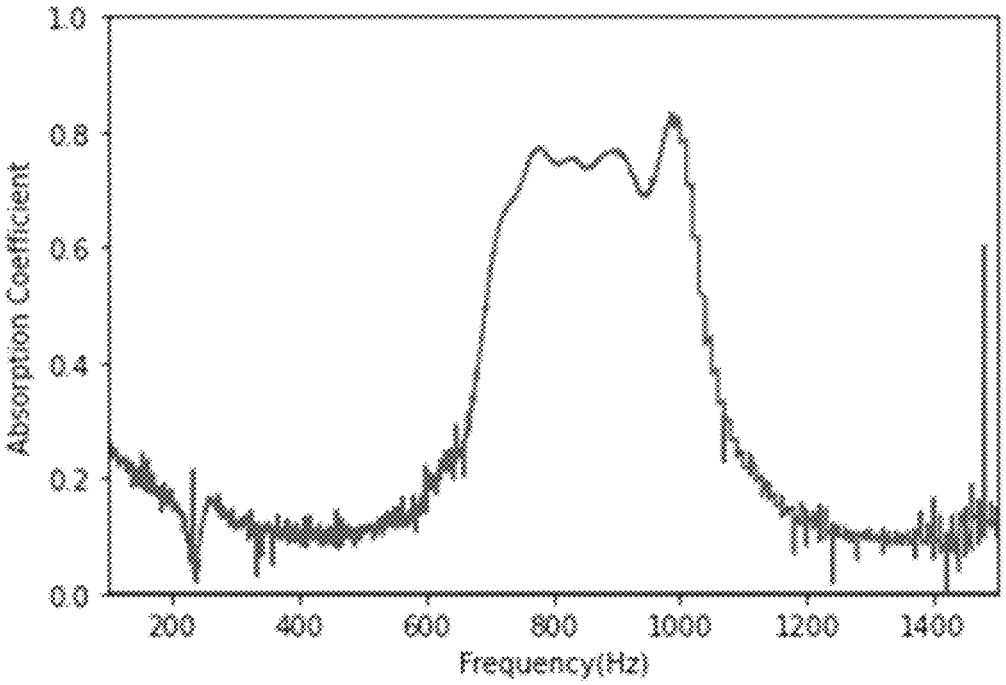
FIG. 4 is a sound absorption coefficient diagram of an air guide ring according to an embodiment of the present application.

FIG. 4 shows the sound absorption coefficient diagram of an air guide ring according to an embodiment of the present application and is used for illustrating the noise reduction effect of the noise reduction devices in the present application, and the air guide ring in the drawing is configured to have a preset inherent frequency covering the range of 700 Hz-1000 Hz. As shown in FIG. 4, the horizontal coordinates represent the frequency range of the noise, and the vertical coordinates represent the sound absorption coefficient of the air guide ring using the noise reduction devices of the present application. It can be seen from FIG. 4 that the air guide ring provided with the noise reduction devices of the present application has a particularly good noise reduction effect on the noise having the frequency in the range of 700 Hz-1000 Hz, and the sound absorption coefficient can basically be 0.8 or above.

After long-term observation, the applicant found that during operation of the axial flow fan, the blades of the impeller will cause the noise due to the air flow disturbances in the air duct between the tips and the annular air guide portion of the air guide ring, and the noise generally have low and medium frequencies and has a relatively large frequency range. The noise of some fans is reduced by improving blade structures; however, this may lead to more serious tip leakage, thereby reducing the working efficiency of the axial flow fans.

According to the air guide ring in the present application, the noise reduction devices are arranged on the inner side wall of the annular air guide portion such that noise reduction can be directly performed at the portion where the noise is generated, thereby reducing the noise more quickly and efficiently. In addition, by means of the principle of noise reduction through resonances, the noise reduction devices in the present application achieve the noise reduction effect by resonating with the sound waves having the certain frequencies in the noise, the intensity of the sound waves can be reduced to a large extent, and thus the noise reduction effect is good.

Besides, the plurality of noise reduction devices in the present application can be configured to resonate with the sound waves having the different frequencies, thereby reducing or eliminating the noise having a plurality of frequencies. Moreover, the plurality of noise reduction devices in the present application are reasonably arranged in the circumferential direction, so that the noise reduction devices can eliminate the noise in a relatively large frequency range.

Although the present disclosure has been described in conjunction with the examples of the embodiments outlined above, various alternatives, modifications, changes, improvements, and/or substantial equivalents, whether known or foreseeable now or in the near future, may be apparent to those with at least ordinary skills in the art. Therefore, the examples of the embodiments of the present disclosure as stated above are intended to be illustrative rather than limiting. Various changes can be made without departing from the spirit or scope of the present disclosure. Therefore, the present disclosure is intended to include all known or previously developed alternatives, modifications, changes, improvements, and/or substantial equivalents. The technical effects and technical problems in this specification are exemplary rather than limiting. It should be noted that the embodiments described in this specification can have other technical effects and solve other technical problems.

The invention claimed is:

1. An air guide ring for an axial flow fan, comprising:

an annular air guide portion, wherein the annular air guide portion has an axis (x) and is rotationally symmetric about the axis (x), the annular air guide portion comprises an air duct configured to accommodate an impeller of the axial flow fan to rotate therein, the annular air guide portion has an inner side wall and an outer side wall, and the air duct is enclosed by the inner side wall; and a plurality of noise reduction devices, wherein the plurality of noise reduction devices is arranged on the inner side wall of the annular air guide portion in a circumferential direction of the air guide ring, each noise reduction device of the plurality of noise reduction devices comprises a resonant cavity and a connecting tube, the resonant cavity is provided between the inner side wall and the outer side wall, and the connecting tube is connected to the inner side wall and extends from the inner side wall to the corresponding resonant cavity in a radial direction relative to the axis (x), wherein each noise reduction device of the plurality of noise reduction devices is configured to reduce noise in the air duct, and each noise reduction device of the plurality of noise reduction devices comprises a channel provided inside the connecting tube, and the channel is in fluid communication with the corresponding resonant cavity and the air duct.

2. The air guide ring of claim 1, wherein each noise reduction device of plurality of the noise reduction devices is configured to have a preset inherent frequency to reduce the noise in the air duct by resonating with sound waves having the preset inherent frequency in the noise.

3. The air guide ring of claim 2, wherein at least two noise reduction devices of the plurality of noise reduction devices are configured to have different preset inherent frequencies.

4. The air guide ring of claim 1, wherein the resonant cavity and the channel of each noise reduction device of the plurality of noise reduction devices extend in the radial direction and extend perpendicular to the inner side wall and the outer side wall.

5. The air guide ring of claim 1, wherein the plurality of noise reduction devices is evenly arranged in an array in the circumferential direction.

6. The air guide ring of claim 5, wherein:

the plurality of noise reduction devices comprises a plurality of annular dividing walls, and each annular dividing wall of the plurality of annular dividing walls is connected between the inner side wall and the outer side wall, and the plurality of noise reduction devices further comprises:

first noise reduction devices, wherein the first noise reduction devices comprise first resonant cavities, and the first resonant cavities are enclosed by the plurality of annular dividing walls; and second noise reduction devices, wherein the second noise reduction devices comprise second resonant cavities, and the second resonant cavities are formed between adjacent annular dividing walls of the plurality of annular dividing walls.

7. The air guide ring of claim 5, wherein each noise reduction device of the plurality of noise reduction devices is configured to form the preset inherent frequency via a volume (V) of the resonant cavity, a length (l) of the connecting tube, and an inner tube diameter (d) of the connecting tube.

8. The air guide ring of claim 5, wherein the preset inherent frequency of each noise reduction device of the plurality of noise reduction devices is different from those of adjacent noise reduction devices of the plurality of noise reduction devices.

9. An axial flow fan, comprising:

an impeller; and the air guide ring according to claim 1.

10. The air guide ring of claim 1, wherein the connecting tube at least partially overlaps a portion of the corresponding resonant cavity in the radial direction.

11. An air guide ring for an axial flow fan, comprising:

an annular air guide portion, wherein the annular air guide portion has an axis (x) and is rotationally symmetric about the axis (x), the annular air guide portion comprises an air duct configured to accommodate an impeller of the axial flow fan to rotate therein, the annular air guide portion has an inner side wall and an outer side wall, and the air duct is enclosed by the inner side wall; and a plurality of noise reduction devices, wherein the plurality of noise reduction devices is arranged on the inner side wall of the annular air guide portion in a circumferential direction of the air guide ring, each noise reduction device of the plurality of noise reduction devices comprises a resonant cavity and a connecting tube, the resonant cavity is provided between the inner side wall and the outer side wall, the connecting tube is connected to the inner side wall and extends from the inner side wall to the corresponding resonant cavity in a radial direction relative to the axis (x), and the connecting tube at least partially overlaps a portion of the corresponding resonant cavity in the radial direction, wherein each noise reduction device of the plurality of noise reduction devices is configured to reduce noise in the air duct.

12. The air guide ring of claim 11, wherein each noise reduction device of plurality of the noise reduction devices is configured to have a preset inherent frequency to reduce the noise in the air duct by resonating with sound waves having the preset inherent frequency in the noise.

13. The air guide ring of claim 12, wherein at least two noise reduction devices of the plurality of noise reduction devices are configured to have different preset inherent frequencies.

14. The air guide ring of claim 13, wherein each noise reduction device of the plurality of noise reduction devices comprises a channel provided inside the connecting tube, and the channel is in fluid communication with the corresponding resonant cavity and the air duct.

15. The air guide ring of claim 14, wherein the resonant cavity and the channel of each noise reduction device of the plurality of noise reduction devices extend in the radial direction and extend perpendicular to the inner side wall and the outer side wall.

16. The air guide ring of claim 14, wherein the plurality of noise reduction devices is evenly arranged in an array in the circumferential direction.

17. The air guide ring of claim 16, wherein:

the plurality of noise reduction devices comprises a plurality of annular dividing walls, and each annular dividing wall of the plurality of annular dividing walls is connected between the inner side wall and the outer side wall, and the plurality of noise reduction devices further comprises:

first noise reduction devices, wherein the first noise reduction devices comprise first resonant cavities, and the first resonant cavities are enclosed by the plurality of annular dividing walls; and second noise reduction devices, wherein the second noise reduction devices comprise second resonant cavities, and the second resonant cavities are formed between adjacent annular dividing walls of the plurality of annular dividing walls.

18. The air guide ring of claim 16, wherein each noise reduction device of the plurality of noise reduction devices is configured to form the preset inherent frequency via a volume (V) of the resonant cavity, a length (l) of the connecting tube, and an inner tube diameter (d) of the connecting tube.

19. The air guide ring of claim 16, wherein the preset inherent frequency of each noise reduction device of the plurality of noise reduction devices is different from those of adjacent noise reduction devices of the plurality of noise reduction devices.

* * * * *